US006075230A

United States Patent [19]

Wilson

[11] Patent Number: 6,075,230

[45] Date of Patent: Jun. 13, 2000

[54] CERAMIC HEATING ELEMENT

[76] Inventor: Frank Wilson, Lowerton, Shull, County Cork, Ireland

[21] Appl. No.: 08/988,904

[22] Filed: Dec. 11, 1997

[30] Foreign Application Priority Data

Dec. 11, 1996 [IE] Ireland ..... S960875

[51] Int. Cl.[7] ..... H05B 3/44

[52] U.S. Cl. ..... 219/544; 392/434

[58] Field of Search ..... 219/544, 546, 219/548, 443, 457, 460, 461, 550, 551, 552, 553; 392/434, 426

[56] References Cited

U.S. PATENT DOCUMENTS 5,271,086 12/1993 Kamiyama et al. ..... 392/483

FOREIGN PATENT DOCUMENTS

| | | |
|---|---|---|
| 26 18 830 | 11/1977 | Germany . |
| 29 19 964 | 11/1982 | Germany . |
| 43 19 019 | 12/1994 | Germany . |
| 1 424 474 | 2/1976 | United Kingdom . |
| 1 581 127 | 12/1980 | United Kingdom . |
| 2 050 130 | 12/1980 | United Kingdom . |

*Primary Examiner*—Mark Paschall
*Assistant Examiner*—Thor Campbell
*Attorney, Agent, or Firm*—Richard C. Litman

[57] ABSTRACT

A heating element comprises a ceramic body having a helical heating wire embedded therein. A short quartz tube closely surrounds the hearing wirs along part of its length, and a thermocouple has its junction embedded in the body substantially in direct contact with the outside of the tube.

10 Claims, 4 Drawing Sheets

CERAMIC HEATING ELEMENT

BACKGROUND OF THE INVENTION

1. Field of the Invention

This invention relates to a ceramic heating element.

2. Description of Related Art

Conventional ceramic heating elements comprise a ceramic body having a heating (resistance) wire embedded therein. When an electric current is passed through the heating wire it causes the wire to heat thereby heating up the ceramic body and causing the latter to emit heat by radiation.

Conventional ceramic heating elements also usually contain an in-built thermocouple located near to the heating wire. A difficulty with conventional designs of element is the positioning of the thermocouple within the element. When positioning a thermocouple within the ceramic body the thermocouple junction must be located a consistent distance from the heating wire in order to give accurate readings. Also there must be no electrical interference between the heating wire and the thermocouple as this can cause electrical damage.

SUMMARY OF THE INVENTION

Accordingly, the present invention provides a heating element comprising a ceramic body having a heating wire embedded therein, a heat transmissive dielectric tube closely surrounding the heating wire along part of its length, and a thermocouple with its junction embedded in the body substantially in direct contact with the outside of the tube.

Heat can be transferred in three ways, by conduction, convection or radiation. As there is no fluid within the ceramic body, heat transfer by convection can be ignored within a ceramic heating element. Therefore, the heat is transferred by radiation and conduction from the heating wires to the ceramic body. The ceramic material is designed to promote heat loss through the front surface of the body, but a problem with conventional element design is that heat is also lost through the back of the element.

Accordingly, the present invention further provides a heating element comprising a ceramic body having front and rear surfaces, a heating wire embedded within the ceramic body, and a heat shield layer of a material which is both heat reflecting and heat insulating embedded in the ceramic body between the heating wire and the rear surface.

DESCRIPTION OF THE DRAWINGS

An embodiment of the invention will now be described, by way of example, with reference to the accompanying drawings, in which.

DETAILED DESCRIPTION OF THE INVENTION

Figure 1:
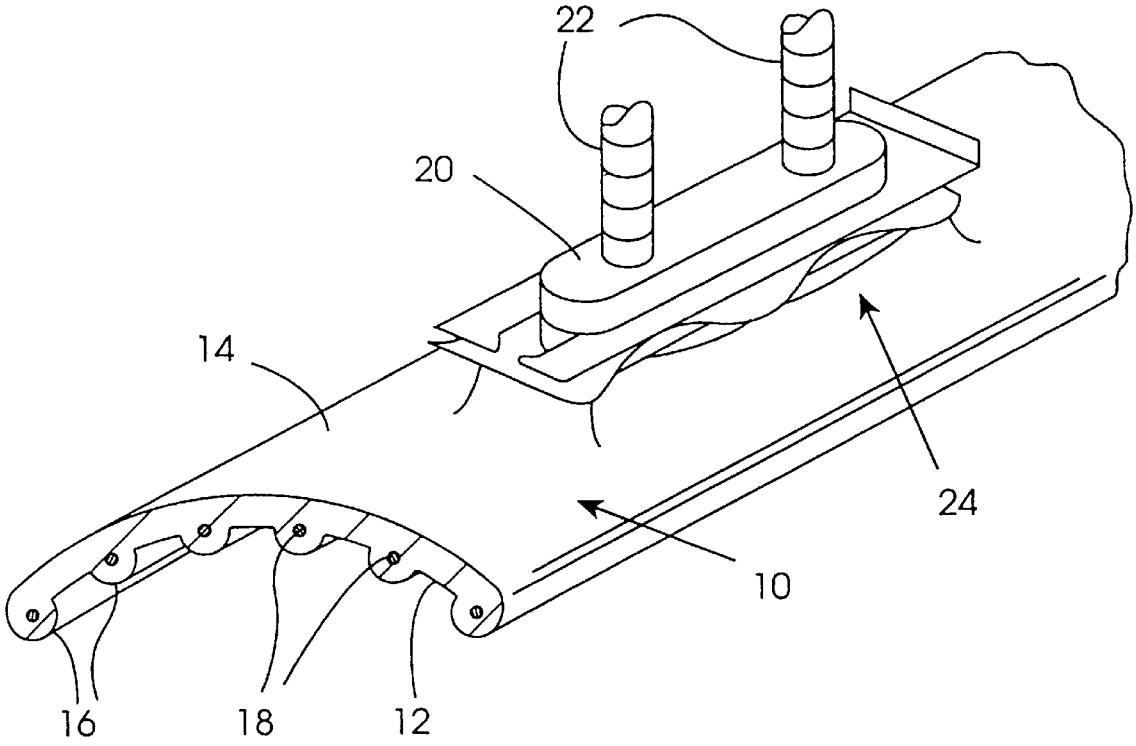
FIG. 1 is a perspective view of a ceramic heating element, sectioned at one end, according to the embodiment of the invention.
Figure 2:
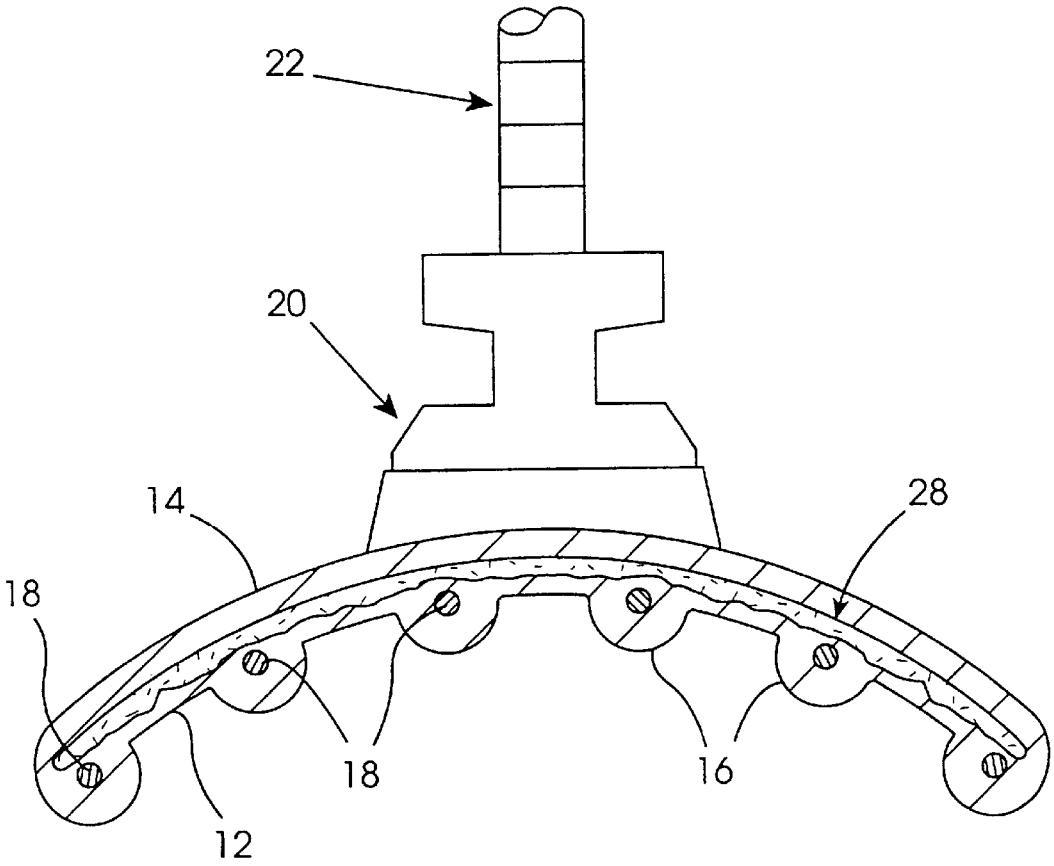
FIG. 2 is a cross-sectional view of the element of FIG. 1.

The ceramic heating element shown in the drawings includes an elongate ceramic body 10 of arcuate cross-section with a concave front surface 12 and a convex rear surface 14. The body 10 has a plurality of substantially parallel, evenly spaced-apart, integral ribs 16 on its front concave surface 12, the ribs extending in the longitudinal direction of the body 10. The body 10, including the ribs 16, is glazed.

A conventional heating wire, in the form of a helical resistance wire 18, is embedded in the body 10. Respective lengths of the heating wire 18 extend along respective ones of the ribs 15. In particular, each rib 16 is substantially of semi-circular cross-section and each length of the heating wire 18 is located substantially at the centre of curvature of the respective rib 16.

A ceramic boss 20 is cast integrally with the body 10 on its rear surface 14. Power leads 22 enter the body 10 through the boss 20 and are connected internally of the body 10 to supply current to the heating wire 18 in known manner. A wave spring and clip 24 permit mounting the heating element to a reflector system, also in known manner.

To reduce heat loss through the rear surface 14 of the body 10, the body 10 has embedded therein, between the heating wire 18 and the rear surface 14, a heat shield layer 28 of material which is both heat reflecting and heat insulating. The material 28 will substantially prevent heat loss by radiation through the rear surface 14 of the body 10 as it reflects the heat radiation back towards the front surface 12, and the material 28 will also substantially prevent transfer of heat by conduction to the rear surface 14 of the body 10.

The heat shield layer 28 is preferably manufactured from a sheet of a high purity heat insulating material made of alumina silicate refractory fibres. After punching to produce the required shape for embedding in the body 10, the sheet is impregnated with an engobe material by drawing the sheet through a bath of a liquid engobe mixture. The bath consists of a mixture of 50% by volume of a ceramic glaze with reflective qualities and 50% by volume of a slip body. The glaze and slip body should have similar coefficients of thermal expansion as the body 10 to reduce the likelihood of failure due to stress cracks. The composite material gives the heat shield layer 28 its heat reflecting and heat insulating properties.

The net result of this heat loss reduction is that more of the heat is forced out the front surface 12 of the body 10 and so can be focused with greater intensity.

This will also give the body 10 a lower thermal inertia, i.e. the amount of energy a body absorbs before it begins to radiate energy, and so reduce the maximum demand or the heating element. Thus the heating element designed in this fashion will reach its operating temperature faster and due to the reduction of heat loss will perform much more efficiently.

The heating element further includes an in-built thermocouple sensor which consists of a pair of wires 30, 32 of dissimilar metal, e.g. nickel/nickel chrome, embedded in the body 10. One portion of the heating wire 18 near the boss 20 is closely surrounded by a short length of quartz tube 34, and the thermocouple junction 36 is located in direct contact with the outside of the quartz tube 34.

By using a quartz tube any difficulties with regard electrical interference between the heating wire 18 and the thermocouple are avoided as quartz is a dielectric material. Also by using quartz, which is transparent to all emitted radiation, the thermocouple can follow rapidly and accurately the temperature change of the heating wire. By locating the thermocouple junction in contact with the quartz tube, which is of known diameter, the distance between the thermocouple and the heating wire is constant for all elements. This will in turn maintain a consistency in the thermocouple readings of different ceramic heating elements.

Figure 3:
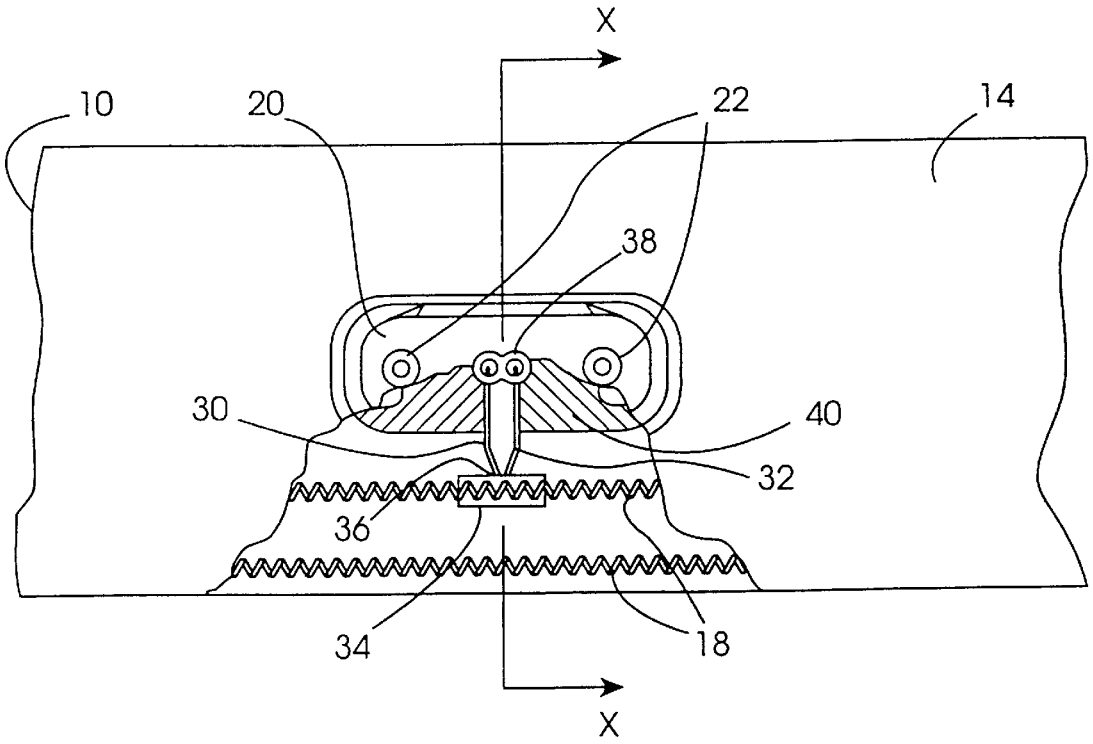
FIG. 3 is a plan view of the rear surface of the element of FIGS. 1 and 2, partially broken away.
Figure 4:
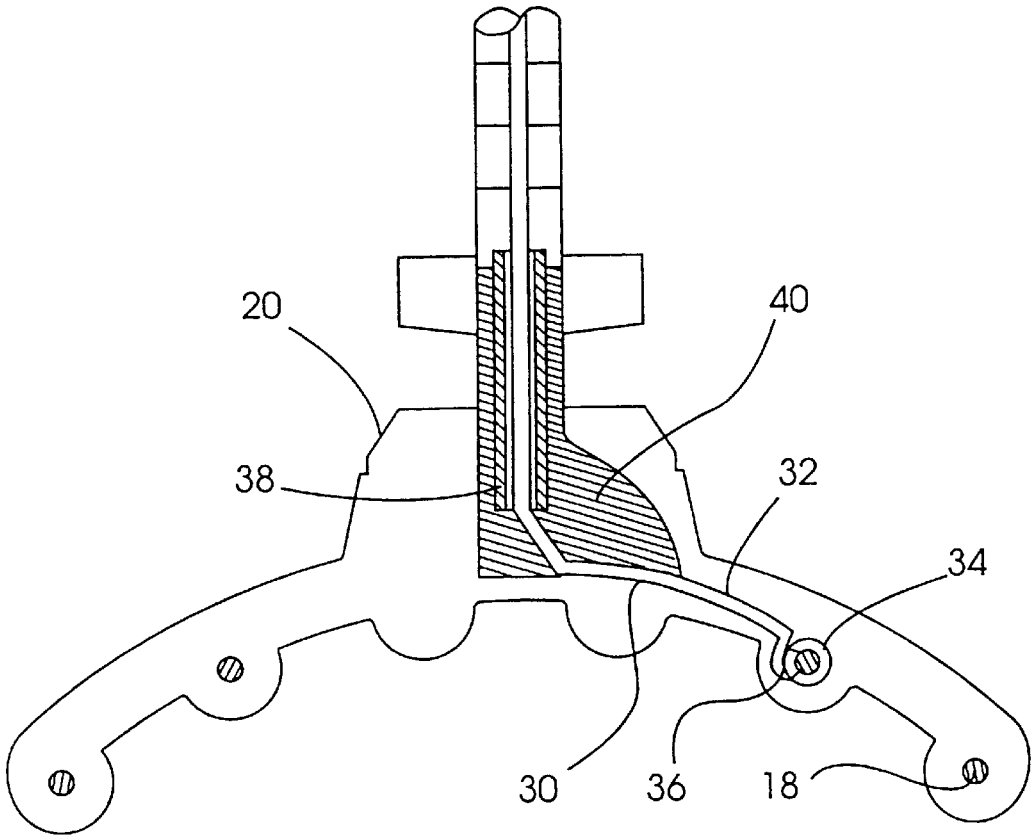
FIG. 4 is a cross-section along the lines X—X in FIG. 3.

The thermocouple wires 30, 32 exit the body 10 through the boss 20, substantially parallel to the power leads 22 (FIG. 3). In order to avoid electrical interference between the thermocouple wires and the power leads, an insulating ceramic tube 38 is placed around the thermocouple wires within the boss.

In addition, the power leads 22 and the thermocouple wires 30, 32 are positioned within a specialised insulating ceramic clay 40, which has a greater dielectric strength to ensure no induced or leakage current will interfere with the performance of the ungrounded thermocouple junction. The ceramic clay 40 comprises a low thermal response, matched engobe material (mixture of matched slip and glaze having similar coefficients of expansion). This is important where controllers may not have optical decoupling on the thermocouple card. The combination of these two features, tube 38 and clay 40, both of which are dielectric materials, substantially eliminates the problem of electrical interference in the boss.

A ceramic heating element has been manufactured according to the principles described above to provide a uniform radiation output with a mass temperature range of 300 dearees centigrade to 750 degrees centigrade producing a wave length range of 6–3 microns.

The invention is not limited to the embodiments described herein which may be varied without departing from the scope of the invention.

I claim:

1. A heating element comprising a ceramic body having a heating wire embedded therein, a heat transmissive dielectric tube closely surrounding the heating wire along part of its length, and a thermocouple with its junction embedded in the body substantially in direct contact with the outside of the tube, wherein the ceramic body has a front surface and a rear surface, and further includes a heat shield layer of a material which is both heat reflecting and heat insulating embedded in the ceramic body between the heating wire and the rear surface, the heat shield layer comprising a fibrous refractory material impregnated with a mixture of a ceramic glaze and a slip body.

2. A heating element as claimed in claim 1, wherein the tube is made of quartz.

3. A heating element as claimed in claim 1, wherein the fibrous refractory material comprises alumina silicate fibres.

4. A heating element as claimed in any one of claim 1, wherein the body is an elongate body of arcuate cross-section, the front surface being concave.

5. A heating element as claimed in claim 4, wherein the front concave surface of the body has a plurality of integral ribs extending in the longitudinal direction of the body, and respective lengths of the heating wire are embedded in the body along respective ribs.

6. A heating element as claimed in claim 5, wherein each rib is substantially of semicircular cross-section and each length of heating wire is located substantially at the centre of curvature of the respective rib.

7. A heating element as claimed in claim 1, wherein the body has a boss for mounting the element to a reflector and power leads for the heating wire exit the body through the boss.

8. A heating element as claimed in claim 7, wherein thermocouple wires also exit the body through the boss and are surrounded in the boss by a ceramic tube.

9. A heating element comprising a ceramic body having front and rear surfaces, a heating wire embedded within the ceramic body, and a heat shield layer of a material which is both heat reflecting and heat insulating embedded in the ceramic body between the heating wire and the rear surface, the heat shield layer comprising a fibrous refractory material impregnated with a mixture of a ceramic glaze and a slip body.

10. A heating element as claimed in claim 9, wherein the fibrous refractory material comprises alumina silicate fibres.

* * * * *